US008771474B2

(12) United States Patent
Sawai

(10) Patent No.: US 8,771,474 B2
(45) **Date of Patent: *Jul. 8, 2014**

(54) CRUDE TREATMENT SYSTEM

(75) Inventor: Naoaki Sawai, Kanagawa (JP)

(73) Assignee: JGC Corporation, Tokyo (JP)

( * ) Notice: Subject to any disclaimer, the term of this patent is extended or adjusted under 35 U.S.C. 154(b) by 779 days.

This patent is subject to a terminal disclaimer.

(21) Appl. No.: 12/927,887

(22) Filed: Nov. 29, 2010

(65) Prior Publication Data

US 2011/0168523 A1 Jul. 14, 2011

(30) Foreign Application Priority Data

Jan. 12, 2010 (JP) ..... 2010-004350

(51) Int. Cl.
*B01D 3/32* (2006.01)
*B01D 3/14* (2006.01)

(52) U.S. Cl.
USPC ..... 196/100; 196/114; 196/133; 202/154; 202/267.1

(58) Field of Classification Search
USPC ..... 196/46, 100, 102, 114, 133; 208/47, 208/347, 350, 354, 355, 357, 366; 202/154, 202/266; 203/7, 86
See application file for complete search history.

(56) References Cited

U.S. PATENT DOCUMENTS 3,303,127 A * 2/1967 Potts et al. ..... 208/355
3,464,915 A * 9/1969 Paterson et al. ..... 208/218
4,082,653 A * 4/1978 DeGraff ..... 208/251 R
4,239,618 A * 12/1980 Peiser et al. ..... 208/355
5,891,325 A 4/1999 Bearden et al.
6,022,494 A 2/2000 Sartori et al.
7,837,855 B2 * 11/2010 Brons et al. ..... 208/48 R (Continued)

FOREIGN PATENT DOCUMENTS

| | | |
|---|---|---|
| EP | 2 354 211 | 8/2011 |
| JP | 2003-534391 | 11/2003 |
| JP | 2006-083395 | 3/2006 |
| WO | WO-2008/120236 | 10/2008 |

OTHER PUBLICATIONS

Derungs W A: "Naphthenic Acid Corrosion an Old Enemy of the Petroleum Industry", Corrosion, Nace International, US, vol. 12, No. 2, Jan. 1, 1956, pp. 41-46, XP 009144971 ISSN: 0010-9312 *abstract* *p. 41, left-hand column, lines 1-10* *p. 42, right-hand column, line 56—p. 42, left-hand column, line 2* *figure 5* *p. 44, left-hand column, lines 13-43* *p. 44, right-hand column, lines 18-50* p. 42, right-hand column, lines 33-42* *p. 45, left-hand column, lines 5-35* *p. 45, right-hand column, lines 20-27* *p. 46, left-hand column, lines 7-21*.

(Continued)

*Primary Examiner* — Nina Bhat
*Assistant Examiner* — Jonathan Miller
(74) *Attorney, Agent, or Firm* — Jordan and Hamburg LLP

(57) ABSTRACT

A crude treatment system includes a primary and second distillation tower for treating crude containing corrosive material. The primary distillation tower fractionates first crude into a target fraction. The secondary distillation tower fractionates second crude having a corrosive material content greater than that of the first crude into a light fraction and a remaining heavy fraction. Corrosive material in the light fraction is insufficient to corrode the primary distillation tower. A light fraction supply line supplies the light fraction from the secondary distillation tower to the primary distillation tower for treatment. The secondary distillation tower and the supply line are made from a corrosion resistant material.

11 Claims, 2 Drawing Sheets

(56) References Cited

U.S. PATENT DOCUMENTS

| | | | | |
|---|---|---|---|---|
| 7,901,564 | B2 * | 3/2011 | Brons et al. | 208/48 R |
| 8,118,994 | B2 * | 2/2012 | Messer et al. | 208/47 |
| 2005/0284796 | A1 | 12/2005 | Benham | |
| 2007/0034550 | A1 * | 2/2007 | Hedrick et al. | 208/113 |
| 2008/0164137 | A1 | 7/2008 | Messer et al. | |
| 2010/0126842 | A1 | 5/2010 | Subramaniyam | |
| 2012/0261308 | A1 * | 10/2012 | Klein et al. | 208/92 |

OTHER PUBLICATIONS

Jayaraman A et al: "Naphthenic Acid Corrosion in Petroleum Refineries. A Review" Oil & Gas Science and Technology—Revue De L Institut Francaisdu Petrole, Editions Technip, Paris, FR, vol. 41, No. 2, Mar. 1, 1986, pp. 265-274, XP009144952, ISSN: 0020-2274, DOI: DOI: 10.2516/OGST: 1986016 *abstract* *figures 1-2* *table 1* *p. 266-p. 268* *p. 270-p. 271* *p. 273*.

Blanco E F et al: "Experience with Naphtenic Acid Corrosion in Refinery Distillation Process Unites", Corrosion '83—The International Corrosion Forum, Anaheim Convention Center, Anaheim, California, Apr. 18-22, 1983, Apr. 18, 1983, pp. Paper No., XP009144949, *tables I-II* *p. 99/2, paragraph 4* *p. 99/3, paragraph Factors that influence corrosion by naphtenic acid—p. 99/4* *p. 99/4, paragraph Methods to prevent corrosion by naphtenic acids—p. 99/5* *p. 99/6, last paragraph* *p. 99/7, last paragraph* *p. 99/9, paragraph conclusions* *abstract*.

Steve White et al: "Refiners processing heavy crudes can experience crude distillation problems", Oil and Gas Journal, Nov. 18, 2002, p. 7PP, XP009144965, ISSN: 0030-1388 [retrieved on Nov. 18, 2002] *figure 4* *p. 1, cols. 1-2* *p. 2, cols. 1-2* *p. 3, col. 2*.

Babaian-Kibala E et al: "Corrosion by Naphthenic Acids in Crude Oils", Preprints, American Chemical Society, Washington, DC, US, vol. 43, No. 1, Jan. 1, 1998, pp. 106-110, XP000910616, ISSN: 0569-3799 *figures 2-3-7* *table 1* *p. 106, cols. 1-2* *p. 107, col. 1*.

* cited by examiner

CRUDE TREATMENT SYSTEM

TECHNICAL FIELD

The present invention relates to a technology of treating crude containing a corrosive material.

BACKGROUND ART

In recent years, the demand for a treatment of crude (hereinafter, corrosive crude) containing a comparatively large content of corrosive material, which had been ignored, has grown due to increasing demand for crude, sudden price jumps, and plateauing production. Meanwhile, there is a case in which it is largely difficult to treat the corrosive crude due to the deterioration of the crude distillation unit (hereinafter, referred to as a CDU) for treating crude.

The content of, for example, a corrosive material such as naphthenic acid contained in the corrosive crude is obtained by using a total acid number (hereinafter, referred to as a TAN) as an index which is the amount of potassium hydroxide (mg-KOH/g) required for neutralizing, for example, 1 g of crude, and it is evaluated that the crude has high corrosiveness as the TAN value increases. In the case of treating the crude having a high corrosiveness, since pipes or equipments are easily corroded particularly in regions in contact with the corrosive crude heated to a high temperature, it is necessary to use, for example, expensive materials such as stainless steel grade/type 317 having high corrosion resistance.

However, in the crude distillation unit, since the unit in contact with the heated corrosive crude corresponds to a preheating heat exchanger group, a heating furnace, a distillation tower, and the like in a wide range, for example, even when the existing crude distillation unit is revamped to treat corrosive crude, the revamping construction is large scale and expensive. In addition, since the period during which the crude distillation unit is stopped for the revamping construction is long, it is not possible to treat any crude during the period, and hence the opportunity loss are huge.

For some time, the corrosive crude has been treated without revamping the crude distillation unit by diluting the corrosive crude with other crude. However, in this case, there are problems in that a large amount of dilution crude is required, and the amount of the corrosive crude treated is largely limited.

Here, for example, a technology has been examined which treats the corrosive crude without revamping the existing crude distillation unit in such a manner that the TAN of the corrosive crude is decreased by neutralizing the corrosive material using a chemical (for example, PTL 1). However, there is a small number of records in which the treatment using the chemical is applied to an actual unit, and in many cases, it is not clear if the device can suppress corrosion of the device.

In addition, in PTL 2, there is disclosed a technology in which crude containing a corrosive material such as naphthenic acid is heated while in contact with inert gas in a thermal reactor so as to decompose the naphthenic acid, and the corresponding crude is separated into a volatile liquid containing naphthenic acid which is not completely decomposed and nonvolatile reactor oil having a small content of naphthenic acid. The volatile liquid neutralizes and divides naphthenic acid contained in the liquid using, for example, a basic chemical such as calcium hydroxide, and the result is mixed with the above-described nonvolatile reactor oil, thereby obtaining raw oil having a small content of naphthenic acid.

However, in the technology disclosed in PTL 2, a heat source for heating the raw oil, inert gas, a chemical for neutralizing the naphthenic acid, and the like are all required, and the variable costs required for the treatment of the raw oil are high. In addition, since the chemical is used to neutralize the naphthenic acid in the volatile liquid, as in the technology disclosed in PTL 1, even when the raw oil having a small content of naphthenic acid and obtained by adopting the technology is made to circulate in the crude treatment unit, there is a small number of proof data for determining whether corrosion of the unit has been prevented.

CITATION LIST

Patent Literature

[PTL 1] JP-A-2006-83395: claim 1 and paragraphs 0024 and 0029 to 0030

[PTL 2] PCT Japanese Translation Patent Publication No. 2003-534391: paragraph 0013 and FIG. 1

SUMMARY OF INVENTION

Technical Problem

The present invention is contrived in consideration of such circumstances, and an object of the invention is to provide a crude treatment system capable of treating crude containing a comparatively large content of corrosive materials.

Solution to Problem

A crude treatment system according to the invention includes: a primary distillation tower which fractionates first crude supplied from a first crude supply line into a target fraction; a secondary distillation tower which fractionates second crude, supplied from a second crude supply line and having a corrosive material content greater than that of the first crude, into a light fraction having a small content of corrosive material and a heavy fraction as the remainder thereof; and a light fraction supply line which supplies the light fraction to the primary distillation tower to be treated, wherein the second crude supply line and the secondary distillation tower are made from a material having corrosion resistance with respect to the corrosive material under circumstances in which the second crude supply line and the secondary distillation tower are in contact with at least one of the second crude and the heavy fraction.

Further, the crude treatment system may have the following characteristics.

(a) There are provided a vacuum distillation tower which distills the heavy fraction into a target fraction in a vacuum condition; and a heavy fraction supply line which supplies the heavy fraction from the secondary distillation tower to the vacuum distillation tower to be processed, wherein the vacuum distillation tower and the heavy fraction supply line are made from a material having corrosion resistance with respect to the corrosive material under circumstances in which the vacuum distillation tower and the heavy fraction supply line contact with the heavy fraction.

(b) There is provided a residue fraction supply line which supplies a residue fraction, fractionated from the bottom portion of the primary distillation tower, to the vacuum distillation tower to be processed.

(c) The material having corrosion resistance includes stainless steel grade/type 317, 317L, 316 (where Mo 2.5% or more), and stainless steel grade/type 316L (where Mo 2.5% or more).

(d) The corrosive material is an acid material of which the content is specified by a total acid number.

(e) The total acid number of the light fraction is 0.5 mgKOH/g or less.

(f) The material having corrosion resistance is used for a portion where the inner conditions are 230° C. or more.

(g) The second crude includes crude selected from a crude group consisting of Mayan crude, Orinoco tar, and oil sand/bitumen.

Advantageous Effects of Invention

According to the invention, there is provided the secondary distillation tower capable of treating the second crude having a large content of corrosive material, and only the light fraction having a small content of corrosive material is extracted from the second crude. Accordingly, even when the light fraction is supplied to the primary distillation tower for treating the first crude having a small content of corrosive material, corrosion does not occur in the primary distillation tower. As a result, since it is possible to treat the second crude without any dilution, there is a wide choice of crude which can be treated in the crude treatment system.

DESCRIPTION OF EMBODIMENTS

Hereinafter, a crude treatment system will be described which is capable of treating corrosive crude containing a comparatively large content of corrosive material such as naphthenic acid and having, for example, a TAN value equal to or greater than 0.5.

Figure 1:
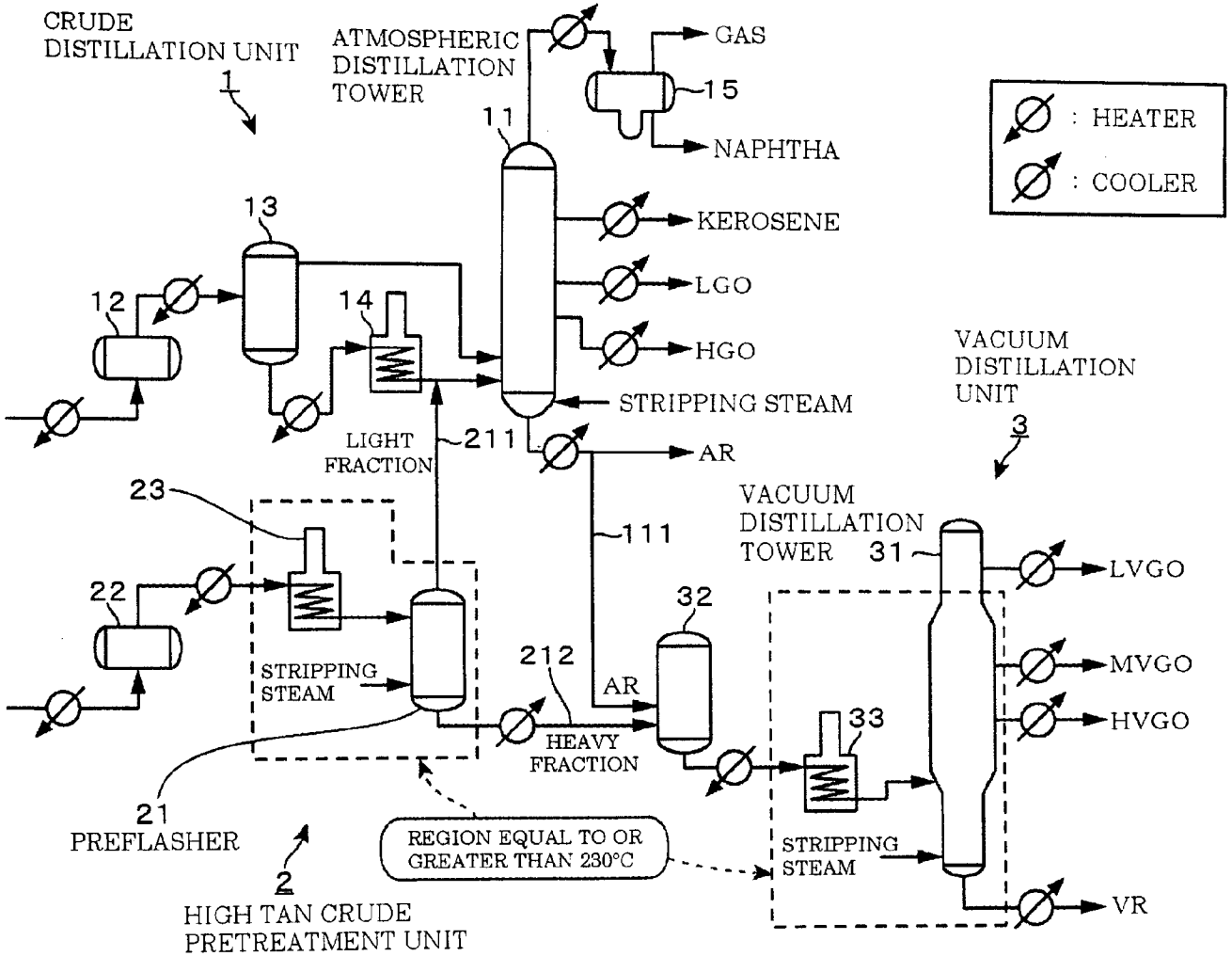
FIG. 1 is an explanatory diagram showing a configuration of a crude treatment system according to an embodiment.

FIG. 1 is an explanatory diagram showing a configuration of a crude treatment system according to the embodiment. The crude treatment system includes, for example, a crude distillation unit 1 which distills general crude having low corrosiveness in an atmospheric state, a vacuum distillation unit 3 which distills atmospheric residue (hereinafter, referred to as AR) fractionated from the crude distillation unit 1, and a high TAN crude pretreatment unit 2 which pretreats corrosive crude so as to send a low corrosive fraction to the crude distillation unit 1 and to send a high corrosive fraction to the vacuum distillation unit 3.

The crude distillation unit 1 is a unit which obtains various interim products by distilling general crude which has, for example, a TAN value equal to or lower than 0.5 and in which corrosiveness is not so high. For example, in the case of light crude or heavy crude produced from Southeast Asia or Middle East, the TAN value is equal to or greater than 0 and equal to or lower than 0.05. The corresponding crude directly supplied to the crude distillation unit 1 corresponds to first crude according to the embodiment.

The crude distillation unit 1 has, for example, a configuration in which a desalter 12, a preflash drum 13, a heating furnace 14, and an atmospheric distillation tower 11 are connected to each other in this order from the upstream side. The desalter 12 performs a function (desalting function) of removing free water or salt contained in the received crude, and the preflash drum 13 separates the desalted crude into, for example, a light fraction such as a naphtha fraction and a heavy fraction heavier than the naphtha fraction so as to directly supply the light fraction to the atmospheric distillation tower 11 and to supply the heavy fraction to the downstream heating furnace 14. The heating furnace 14 heats the heavy fraction supplied from the preflash drum 13, for example, at a temperature equal to or greater than 300° C. and equal to or lower than 380° C., and supplies the heated heavy fraction to the atmospheric distillation tower 11.

The pipes connecting the units 12, 13, and 14 to each other are provided with a heater such as a heat exchanger group so as to preheat the crude or the heavy fraction to be supplied to the preflash drum 13 or the heating furnace 14 up to a predetermined temperature. A series of unit groups including the desalter 12, the preflash drum 13, the heating furnace 14, and the pipes connecting them to each other correspond to a first crude supply line according to the embodiment.

The atmospheric distillation tower 11 is a primary distillation tower which distills the light fraction received from the preflash drum 13 and the heavy fraction received from the heating furnace 14 in an atmospheric pressure state so as to fractionally distill them into respective interim products including fractions such as naphtha, kerosene, light gas oil (hereinafter, referred to as LGO), heavy gas oil (hereinafter, referred to as HGO) and AR and an overhead gas, and is configured as, for example, a known tray-type distillation tower.

The bottom portion of the atmospheric distillation tower 11 is connected to a pipe which supplies stripping steam for the separation of the light fraction of oil, and the overhead portion thereof is provided with a receiver 15 which cools the overhead gas so as to obtain the overhead gas and naphtha. In addition, the atmospheric distillation tower 11 is provided with a reflux line which improves the separation of the fractions or a side stripper which separates the light fraction of the kerosene, the LGO, and HGO withdrawn from the atmospheric distillation tower 11 by using steam, but, for convenience of description, these are not depicted in the drawing. The fractions of the HGO, the LGO, the kerosene, and the naphtha fractionated from the atmospheric pressure tower 11 and cooled by a cooler are sent to the downstream unit such as a desulfurization unit. Meanwhile, the AR as the residue fraction from the bottom portion of the tower is sent to the downstream vacuum distillation unit 3 through an AR transfer pipe 111 (residue fraction supply line) so as to be distilled in a vacuum condition. The AR transfer pipe 111 is branched from, for example, the downstream of the cooler so as to discharge the AR toward the downstream unit.

The vacuum distillation unit 3 has, for example, a configuration in which a surge drum 32, a heating furnace 33, and a vacuum distillation tower 31 are connected to each other in this order from the upstream side. The surge drum 32 temporarily stores the AR or the like received from the atmospheric distillation tower 11, and discharges the stored AR or the like to the heating furnace 33. The heating furnace 33 heats the vacuum distillation raw material supplied from the surge drum 32, for example, at a temperature equal to or greater than 380° C. and equal to or lower than 420° C.

The vacuum distillation tower 31 distills the raw oil received from the heating furnace 33 under the vacuum condition, for example, a degree of 1.33 kPa to 13.3 kPas (10 mmHg to 100 mmHg) so as to be fractionated into fractions of, for example, light vacuum gas oil (hereinafter, referred to as LVGO), middle vacuum gas oil (hereinafter, referred to as MVGO), heavy vacuum gas oil (hereinafter, referred to as HVGO), and vacuum residue (hereinafter, referred to as VR), and is configured as, for example, a tray-type distillation tower.

As in the above-described atmospheric distillation tower 11, the bottom portion of the vacuum distillation tower 31 is connected to a pipe which supplies stripping steam for the separation of the light fraction of the oil. In addition, the LVGO, MVGO, and HVGO fractionated from the vacuum distillation tower 31 is sent to a downstream unit such as a desulfurization unit, and the VR is used as, for example, raw materials of heavy oil bases, cokes, or asphalts.

The above-described crude treatment system is provided with the high TAN crude pretreatment unit 2 for treating corrosive crude (hereinafter, referred to as high TAN crude) having, for example, a TAN value equal to or greater than 0.5. Hereinafter, the detail of the high TAN crude pretreatment unit 2 will be described.

The present inventor has found that there is a common characteristic between the fractions constituting the high TAN crude and the values of TAN of the fractions. For example, FIG. 2 is a characteristic diagram in which the schematic trend of the TAN value of the fractions at the fractionation temperature with respect to the fractionation temperature of the corresponding crude is plotted in the high TAN crude such as Mayan crude, Orinoco tar, and oil sand/bitumen.

Figure 2:
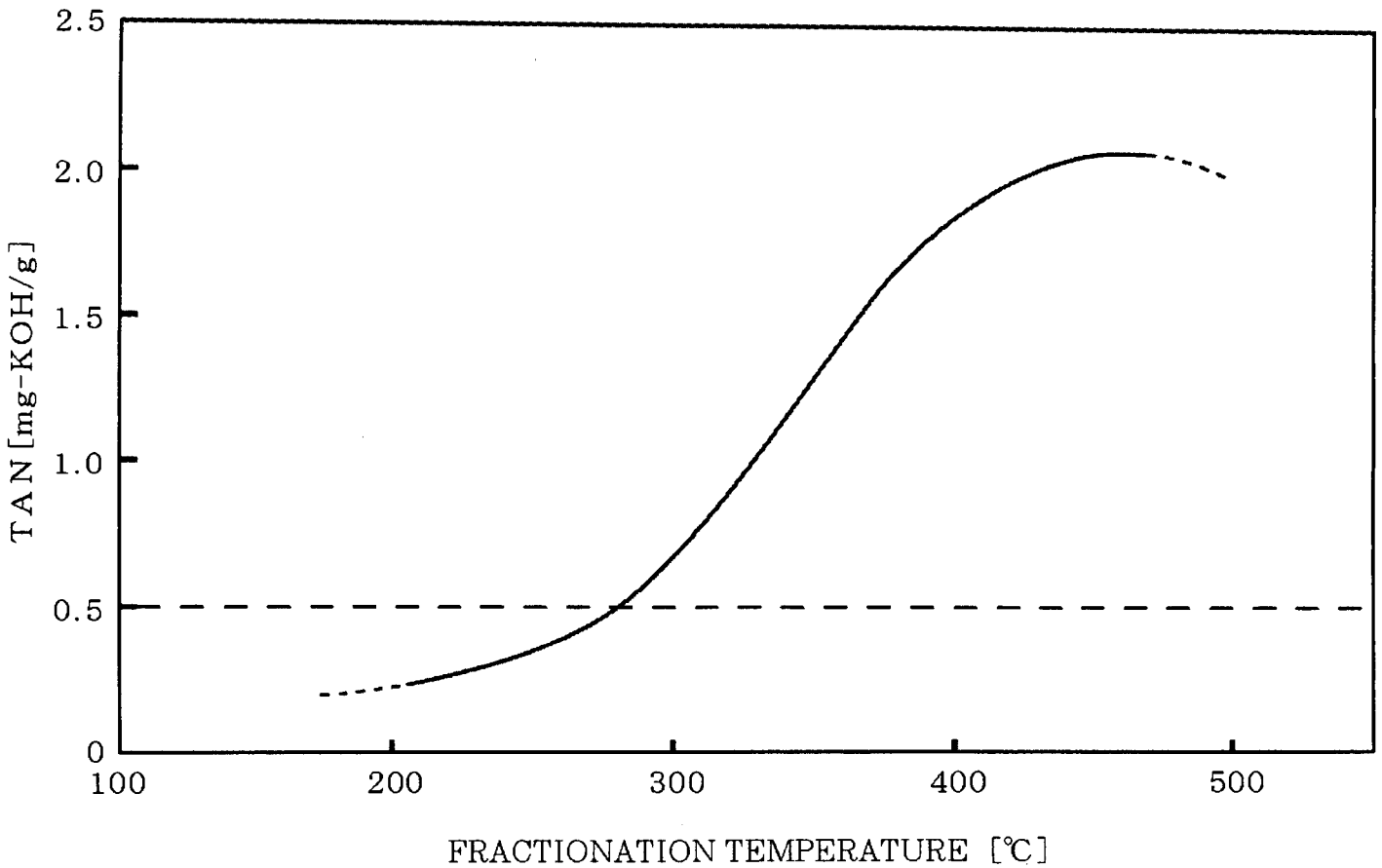
FIG. 2 is a characteristic diagram showing an example of a variation in TAN with respect to a fractionation temperature of high TAN crude.

According to FIG. 2, in the high TAN crude, it is understood that the TAN value in the light fraction having a low fractionation temperature is comparatively low, and the TAN value in the heavy fraction having a high fractionation temperature is comparatively high. Here, for example, when the fraction (hereinafter, referred to as a light fraction) having a fractionation temperature in which the content of corrosive material is small and the TAN value is less than 0.5 is separated from the high TAN crude, the TAN value of the total light fraction is also less than 0.5. Accordingly, even when the corrosion countermeasure for the naphthenic acid is not studied in the crude distillation unit 1 or the naphthenic acid is not diluted with crude having a small TAN value, it is possible to treat the corresponding light fraction without causing corrosion in the atmospheric distillation tower 11 and the like.

Here, "the case where corrosion does not occur" includes the case where the degree of corrosion is suppressed to the degree that sufficient material strength is maintained during an update cycle of the corresponding material even when corrosion of the corresponding material occurs, in addition to the case where corrosion does not occur in the material forming the atmospheric distillation tower 11. The high TAN crude pretreatment unit 2 according to the embodiment is configured on the basis of the consideration, and the high TAN crude supplied to the high TAN crude pretreatment unit 2 corresponds to second crude of the embodiment.

The high TAN crude pretreatment unit 2 has, for example, a configuration in which a desalter 22 for desalting salt or the like in the high TAN crude, a heating furnace 23 for heating the desalted high TAN crude at a temperature equal to or greater than 200° C. and equal to or lower than 370° C., and a preflasher 21 are connected to each other in this order from the upstream side. A series of unit groups including the desalter 22, the heating furnace 23, and the pipes connecting them to each other correspond to a second crude supply line according to the embodiment.

The preflasher 21 is a distillation tower which fractionates the high TAN crude received from the heating furnace 23 into a light fraction (for example, a fraction having a fractionation temperature in which the TAN value in the fraction is less than 0.5) and a heavy fraction heavier than that. The preflasher 21 is not limited to a particular type, but may be a tray-type distillation tower. For example, a flash-distillation-type distillation tower may be used. In addition, temperature conditions and a pressure condition are not limited to a particular rage of condition, but the light fraction and the heavy fraction may be fractionated at a target temperature. The preflasher 21 corresponds to a secondary distillation tower according to the embodiment.

Here, when the TAN value of the light fraction is equal to or lower than 0.5 in the total corresponding light fraction, it is possible to perform the treatment in the atmospheric distillation tower 11, but it is not possible to prevent the fraction of the heavy fraction being mixed with the light fraction in accordance with the sharpness of separation between the light fraction and the heavy fraction. Here, the preflasher 21 according to the embodiment is used to obtain the fractions of the light fraction and the heavy fraction so that the value of the TAN of the fraction at, for example, 90% of the fractionation temperature of the light fraction is equal to 0.5. For example, even when about 10% of the heavy fraction is mixed with the light fraction, the total TAN value of the light fraction does not exceed 0.5.

For example, in FIG. 2, in the case where the fractionation temperature, in which the TAN value is 0.5, is about 260° C., the light fraction lighter than kerosene is supplied to, for example, the atmospheric distillation tower 11 of the crude distillation unit 1 through a light fraction supply pipe 211. Then, the heavy fraction heavier than the LGO is supplied to, for example, the surge drum 32 of the vacuum distillation unit 3 through a heavy fraction supply pipe 212 so as to be distilled in a vacuum condition. Here, the light fraction supply pipe 211 and the pipe merged to the light fraction supply pipe 211 and supplying the light fraction to the atmospheric distillation tower 11 correspond to a light fraction supply line according to the embodiment. The heavy fraction supply pipe 212, the surge drum 32, the heating furnace 33, and the pipes connecting them to each other correspond to a heavy fraction supply line.

At this time, for example, as described above, the atmospheric distillation tower 11 of the crude distillation unit 1 is configured to treat the low corrosive crude in which for example, the TAN value is less than 0.5. In this case, as each of the units started from the atmospheric distillation tower 11, for example, a material such as 5Cr-0.5Mo steel or 18Cr steel is used which has sulfidation corrosion resistance and low resistance to corrosion caused by naphthenic acid.

Meanwhile, in the heavy fraction or the high TAN crude containing a large content of a corrosive material such as naphthenic acid, it is known that corrosion occurs in, for example, temperature conditions equal to or greater than 230.degree. C. Here, in the crude treatment system according to the embodiment, among the units constituting the high TAN crude pretreatment unit 2 or the vacuum distillation unit 3, the pipes or equipments in a region in contact with the high TAN crude or the heavy fraction heated up to, for example, 230.degree. C. or more is made from a material having high corrosion resistance. As the material having high corrosion resistance, for example, in addition to the above-described stainless steel grade/type 317 (which is specified in JIS G4305 or the like such that Cr: 18 to 20%, Ni: 11 to 15%, Mo: 3 to 4%, and C: 0.08% or less), it is very preferable to adopt SUS317L (which is equal to SUS317 except that C: 0.03% or less), stainless steel grade/type 316 (Cr: 16 to 18%, Ni: 10 to 14%, Mo: 2 to 3%, and C: 0.08% or less), stainless steel grade/type 316L (which is equal to stainless steel grade/type 316 except that Ni: 12 to 15% and C: 0.03% or less), and the like. However, in the cases of stainless steel grade/type 316 and 316L it is desirable that the content of MO is 2.5% or more.

In this example, for example, a range surrounded by the dashed line in FIG. 1, that is, a region including the inlet of the heating furnace 23 of the high TAN crude pretreatment unit 2, the body of the preflasher 21, and the cooler of the heavy fraction supply pipe 212, a region from the outlet of the heater of the surge drum 32 of the vacuum distillation unit 3 to a height position where the distillation temperature of the body of the vacuum distillation tower 31 is equal to or greater than 230° C., and a region up to a position before the cooler of the supply pipe of the MVGO, HVGO, and VR are made from a material having high corrosion resistance. Here, the range where the material having high corrosion resistance is used may be a region where for example, the high TAN crude or the heavy fraction has a temperature equal to or greater than 220° C. and has, for example, an allowance of about 10° C. with respect to 230° C.

In addition, the raw material supply pipes of the crude distillation unit 1, the high TAN crude pretreatment unit 2, and the vacuum distillation unit 3 according to the embodiment, the interim product supply pipe, the fuel supply pipes of the heating furnaces 14, 23, and 33, and the like are provided with control terminals such as flow rate control valves. The control terminals cooperate with each other to constitute a DCS (Distributed Control System) which controls the entire crude treatment system. Accordingly, for example, it is possible to control the fractionation temperature range of the light fraction, the heavy fraction, or the interim product.

In addition, for example, the kerosene, LGO, and HGO fractionated from the atmospheric distillation tower 11 are periodically sampled, and the TAN value of each of the interim products thereof is measured. Then, when the TAN value of the interim product is equal to or greater than, for example, 0.5, the fuel supply amount to the heating furnace 23 is decreased, so that the temperature of the high TAN crude supplied to the preflasher 21 is decreased and the TAN value of the light fraction is decreased, thereby controlling the TAN value of the crude (including the light fraction) distilled in the atmospheric distillation tower 11 so as to be less than 0.5. In addition, in the case where the analysis of TAN can be performed on line, a feedback control may be, of course, performed so as to control the temperature of the high TAN crude of the outlet of the heating furnace 23 on the basis of a detection value of an on-line analysis system.

When the high TAN crude is supplied to the high TAN crude pretreatment unit 2 having the above-described configuration, the temperature of the high TAN crude is increased up to a predetermined temperature through the desalter 22 and the heating furnace 23 so as to obtain the light fraction having a TAN value less than 0.5 and the residual heavy fraction in the inside of the preflasher 21. At this time, since the heating furnace 23, the preflasher 21, and the like in contact with the heavy fraction or the high TAN crude heating up to 230° C. or more are made from a material having high corrosion resistance, corrosion caused by the corrosive material such as naphthenic acid does not occur.

In addition, since the content of the corrosive material of the light fraction separated in the preflasher 21 is decreased in the atmospheric distillation tower 11 up to a degree that corrosion does not occur in the atmospheric distillation tower 11, it is possible to distil the light fraction together with the crude directly supplied to the crude distillation unit 1. The fractions obtained in this manner are sent to the downstream unit.

In addition, at this time, the TAN value of each of the kerosene, LGO, and HGO fractionated from the atmospheric distillation tower 11 is periodically monitored. Then, for example, when the TAN value of any one of interim products exceeds 0.5 due to a reason such as a variation in property of the high TAN crude, the temperature of the outlet of the heating furnace 23 of the high TAN crude pretreatment unit 2 is decreased so as to transfer the fraction having a comparatively high fractionation temperature among the light fraction, of which the TAN value is high, to the heavy fraction. Accordingly, the TAN value of the light fraction supplied to the atmospheric distillation tower 11 is decreased, so that the occurrence of corrosion is suppressed.

Meanwhile, the heavy fraction containing a large content of corrosive material separated in the preflasher 21 is transferred to the vacuum distillation unit 3, and is distilled in a vacuum condition in the vacuum distillation tower 31 together with the AR from the crude distillation unit 1. The fractions are sent to the downstream unit. At this time, even in the vacuum distillation unit 3, since the heating furnace 33, the vacuum distillation tower 31, or the like in contact with the heavy fraction heated up to a temperature equal to or greater than 230° C. is made from a material having high corrosion resistance, corrosion does not occur due to the corrosive material such as naphthenic acid. Here, since the corrosive material such as naphthenic acid contained in the fractions fractionated from the vacuum distillation unit is diluted by the mixture with the fraction fractionated from, for example, the atmospheric distillation tower 11, and is further decomposed when the corrosive material is treated by the downstream desulfurization unit or the like, a problem caused by considerable corrosion does not occur.

In the crude treatment system according to the embodiment, there is a following advantage. There is provided the preflasher 21 capable of treating the high TAN crude (second crude) having a large content of corrosive material such as naphthenic acid, and only the light fraction having a small content of corrosive material is extracted from the high TAN crude. Accordingly, even when the light fraction is treated in the atmospheric distillation tower 11 for treating the crude (first crude) having a small content of corrosive material, corrosion does not occur in the atmospheric distillation tower 11. As a result, since it is possible to treat the high TAN crude without any dilution, there is a wide choice of crude which can be treated in the crude treatment system.

In addition, compared with the crude distillation unit 1 in which a large number of heat exchangers (heater/cooler) is provided from the viewpoint of a heat recovery, in the high TAN crude pretreatment unit 2 for fractionating the high TAN crude into two fractions (the light fraction and the heavy fraction), the size of the preflasher 21 is smaller than that of the atmospheric distillation tower 11, and the number of the heat exchangers is smaller than that of the atmospheric distillation tower. For this reason, for example, the atmospheric distillation tower 11 or the region equal to or greater than 230° C. of the crude supply line of the crude distillation unit 1 is made from a material having high corrosion resistance. Accordingly, since the usage amount of the material having corrosion resistance is small compared with the case where the high TAN crude is directly supplied to the crude distillation unit 1, it is possible to suppress the construction costs of the unit. The same applies to the case where the supply line or the vacuum distillation tower 31 of the vacuum distillation unit 3 are made from a material having corrosion resistance in addition to the high TAN crude pretreatment unit 2.

Further, even in the case where the existing crude distillation unit 1 is revamped so as to treat the high TAN crude, after the high TAN crude pretreatment unit 2 or the vacuum distillation unit 3 is constructed in, for example, adjacent regions while continuing the operation of the crude distillation unit 1, and the constructed units may be connected to the crude distillation unit 1, thereby contributing to a reduction in the opportunity loss by suppressing the stop time of the crude distillation unit 1 to be short.

Here, the supply ratio between the crude (first crude) having a small content of corrosive material and supplied to the crude distillation unit 1 and the high TAN crude (second crude) supplied to the high TAN crude pretreatment unit 2 is appropriately set by, for example, the operable supply amount range or the size of the atmospheric distillation tower 11 or the preflasher 21, but the invention is not limited to the case where the crude is supplied in parallel from both lines. For example, in a state where the supply of the crude from one crude supply line is stopped so that the crude is circulated in the one crude supply line, the operation may be performed by using the crude supplied only from the other crude supply line.

In addition, in the above-described embodiment, in order to suppress the narrow range where the material having high corrosion resistance is used, a case has been described in which for example, a region in contact with the heavy fraction or the high TAN crude equal to or greater than 230° C. is made from the material having corrosion resistance, but the other regions may be also made from the material having high corrosion resistance. For example, the invention includes the case where all of the high TAN crude pretreatment unit 2 or the vacuum distillation unit 3 is made from the material having high corrosion resistance.

Then, the TAN value of the light fraction extracted from the preflasher 21 is not limited to a value less than 0.5, but the light fraction and the heavy fraction may be fractionated so that the value is equal to or lower than that. For example, the light fraction may be extracted so that the value is higher than that in accordance with the corrosion resistance property of the atmospheric distillation tower 11.

Further, the crude treatment system according to the invention may not be provided with the vacuum distillation tower 31 capable of treating the heavy fraction containing a large content of corrosive material. The heavy fraction separated from the preflasher 21 may be directly desulfurized to be used as the base of a heavy oil, or the heavy fraction may be transferred to another refinery, including the vacuum distillation tower 31 capable of treating the AR containing a large content of corrosive material, so as to be treated.

In addition, in this example, as the corrosive material contained in the crude, the corrosive material such as naphthenic acid which is evaluated by the index of the TAN value is exemplified, but the type of the corrosive material contained in the crude which can be treated by the invention is not limited thereto. For example, as shown in FIG. 2, if the corrosive material has a characteristic in which the content of the light fraction is smaller, the spirit of the invention may be applied, where the spirit is that only the light fraction having a small content of corrosive material is extracted, and is treated in the atmospheric distillation tower 11.

Further, even when the characteristics obtained by the plotting the TAN value with respect to the fractionation temperature of the crude is different from that of FIG. 2, the spirit of the invention may be applied. For example, even in the case having a characteristic in which the content of the corrosive material becomes small as the fractionation temperature becomes high, a case having characteristics in which the content of the corrosive material is large at the middle fractionation temperature, or a case having characteristics in which the content of the corrosive material is small at the middle fractionation temperature, the fraction having a small content of corrosive material may be separated from the high TAN crude pretreatment unit 2 so as to be supplied to the atmospheric distillation tower 11.

DESCRIPTION OF REFERENCE NUMERALS AND SIGNS

1: CRUDE DISTILLATION UNIT
11: ATMOSPHERIC DISTILLATION TOWER
2: HIGH TAN CRUDE PRETREATMENT UNIT
21: PREFLASHER
211: LIGHT FRACTION SUPPLY PIPE
212: HEAVY FRACTION SUPPLY PIPE
3: VACUUM DISTILLATION UNIT
31: VACUUM DISTILLATION TOWER

The invention claimed is:

1. A crude treatment system comprising:

a primary distillation tower which fractionates first crude supplied from a first crude supply line into a target fraction;

a secondary distillation tower which fractionates second crude into a light fraction and a remaining heavy fraction, the light fraction having a first content of naphthenic acid, the second crude being supplied from a second crude supply line and including naphthenic acid as a corrosive material at a content greater than in the first crude; and a light fraction supply line which supplies the light fraction to the primary distillation tower to be treated; and wherein the second crude supply line and the secondary distillation tower are made from a first material having corrosion resistance with respect to the naphthenic acid in an environment in which the second crude supply line and the secondary distillation tower contact naphthenic acid from either one or both of the second crude and the heavy fraction; and wherein the first crude supply line and the primary distillation tower are made from a second material having lesser corrosion resistance against naphthenic acid than the first material.

2. The crude treatment system according to claim 1, further comprising:

a vacuum distillation tower which distills the heavy fraction into a target fraction in a vacuum condition; and a heavy fraction supply line which supplies the heavy fraction from the secondary distillation tower to the vacuum distillation tower to be processed; and wherein the vacuum distillation tower and the heavy fraction supply line are made from a third material having corrosion resistance with respect to the naphthenic acid in an environment in which the vacuum distillation tower and the heavy fraction supply line contact the heavy fraction; and wherein the second material of the first crude supply line and the primary distillation tower has lower corrosion resistance against naphthenic acid than the third material.

3. The crude treatment system according to claim 2, further comprising:

a residue fraction supply line which supplies a residue fraction, fractionated from the bottom portion of the primary distillation tower, to the vacuum distillation tower to be processed.

4. The crude treatment system according to claim 1, wherein said first material, from which the second crude supply line and the secondary distillation tower are made, is selected from the group consisting of stainless steel type 317, 317L, 316 (where Mo content is 2.5% or more) and 316L (where Mo content is 2.5% or more).

5. The crude treatment system according to claim 1, wherein the naphthenic acid is contained in acid materials of which the content is specified by a total acid number.

6. The crude treatment system according to claim 5, wherein the total acid number of the light fraction is 0.5 mg-KOH/g or less.

7. The crude treatment system according to claim 5, wherein the material having corrosion resistance is used for a portion where the inner temperature is 230° C. or more.

8. The crude treatment system according to claim 1, wherein the second crude includes crude selected from a crude group consisting of Mayan crude, Orinoco tar, and oil sand/bitumen.

9. The crude treatment system according to claim 2, wherein the third material from which the vacuum distillation tower and the heavy fraction supply line are made is selected from the group consisting of stainless steel type 317, 317L, 316 (where Mo content is 2.5% or more), and 316L (where Mo content is 2.5% or more).

10. The crude treatment system according to claim 1, wherein the first crude supply line and the primary distillation tower are made from a second material having corrosion resistance for the sulfidation corrosion.

11. The crude treatment system according to claim 10, wherein the first material from which the first crude supply line and the primary distillation tower are made is selected from the group consisting of 5Cr—0.5Mo steel and 18Cr steel.

* * * * *